US005779095A

United States Patent [19]

Diamond

[11] Patent Number: 5,779,095

[45] Date of Patent: Jul. 14, 1998

[54] PORTABLE GUMBALL DISPENSER

[75] Inventor: Sidney Diamond, Barrington Hills, Ill.

[73] Assignees: Imaginings 3, Inc., Niles, Ill.; Imaginings 3 Int'l Ltd., Jersey, Channel Islands

[21] Appl. No.: 792,519

[22] Filed: Jan. 31, 1997

[51] Int. Cl.[6] ..... B65G 57/00

[52] U.S. Cl. ..... 221/263; 221/281; 221/282; 221/24

[58] Field of Search ..... 221/24, 263, 265, 221/281, 282, 284

[56] References Cited

U.S. PATENT DOCUMENTS

| | | | |
|---|---|---|---|
| 1,109,134 | 9/1914 | Millard . | |
| 1,238,182 | 8/1917 | Nichols et al. . | |
| 1,792,763 | 2/1931 | Ryan . | |
| 2,149,445 | 3/1939 | Kreiten | 206/42 |
| 2,204,821 | 6/1940 | Priddy | 221/62 |
| 2,580,096 | 12/1951 | Holt et al. | 221/263 |
| 3,638,830 | 2/1972 | Belokin, Jr. | 221/246 |
| 3,730,387 | 5/1973 | McConnell et al. | 221/265 |
| 3,866,797 | 2/1975 | Palomo | 221/263 |
| 3,991,908 | 11/1976 | Thomas et al. | 221/154 |
| 4,613,057 | 9/1986 | Sacchetti et al. | 221/265 |
| 5,385,267 | 1/1995 | Diamond et al. | 221/248 |

FOREIGN PATENT DOCUMENTS

| | | | |
|---|---|---|---|
| 1098150 | 3/1955 | France | 221/263 |
| 1 328 990 | 4/1963 | France | 221/263 |

*Primary Examiner*—H. Grant Skaggs
*Attorney, Agent, or Firm*—Dick and Harris

[57] ABSTRACT

A portable gumball dispenser has a reservoir mounted atop a pedestal formed of a nested assembly of concentric tubular members and a base. When offset apertures in top walls of the tubular members are in register with each other and with an opening in the bottom of the reservoir to permit a single gumball to drop into a dispensing chamber within the pedestal, apertures in the side walls are out of register to retain the gumball. Rotation of the tubular members to register the side wall apertures rotates the top wall apertures out of register to block any further gumballs dropping from the reservoir. A directional channel in the base facilitates a gumball rolling out when the side wall apertures in register. A cooperating annular ridge on the outside of the inner tubular member and an annular groove on the outer tubular member retain the tubular members in nested assembly. Extending upwardly from the inner tubular member is a bead which cooperates with an arcuate groove in the outer tubular member to provide respective rotational stops for the register of the top wall apertures and the side wall apertures.

20 Claims, 2 Drawing Sheets

PORTABLE GUMBALL DISPENSER

BACKGROUND OF THE INVENTION

1. Field of the Invention

This invention relates generally to confectionery dispensing devices and more particularly to portable dispensers for generally spherical confectionery such as gumballs.

2. Background Art

Confectioneries, particularly gumballs, have long been popular with both children and adults. Dispensers for gumballs have similarly long been popular and have fascinated children for many years. Commercial gumball dispensers requiring the deposit of a coin in order to obtain a gumball have existed in the prior art for many years. Similarly, miniature versions of the commercial dispensers have been used as a popular form of savings banks for children. Even smaller, more portable dispensers of gumballs, such as that disclosed in Diamond et al., U.S. Pat. No. 5,385,267 have more recently become popular. Such a portable dispenser is generally of a size to readily fit in a child's pocket or carrying bag. The dispenser has a clear tubular reservoir holding a number of gumballs. The reservoir is movable, generally along its axis, with respect to a base such that downward movement of the tubular reservoir actuates a mechanism releasing a single gumball from the base. Mounted on the top of the tubular reservoir and serving as a removable cap permitting refilling of the tubular reservoir is an embellishment conveniently styled as a head of a character. There continues to be a need for small, portable gumball dispensers that will dispense one gumball at a time from beneath a reservoir, on which may be mounted a character head or other amusing embellishment, and which are easy to operate and manufacture.

SUMMARY OF THE INVENTION

The present invention is concerned with providing a portable gumball dispenser of a simple construction that is economical to manufacture and easy to use. The dispenser includes a reservoir having an opening at the bottom through which one gumball at a time may drop and an opening at the top for feeding gumballs into the reservoir upon demand. A movable cap is carried at the top of the reservoir and positionable in at least a position closing the top of the reservoir and another position leaving the top of the reservoir open for the insertion of gumballs into the reservoir. The dispenser also includes a pedestal having a nested assembly of two substantially concentric, relatively rotatable cylindrical tubular members, each having a top and an open bottom. The pedestal also includes a base which closes off the bottom of both of the nested cylindrical tubular members. On top of the outer cylindrical tubular member is a top wall in which there is a circular aperture of a diameter sufficient for passage of a single gumball. Disposed around the circular aperture is an upwardly projecting collar into which the reservoir may be seated with the bottom opening of the reservoir in register with the circular aperture in the top of the outer cylindrical tubular member. There is also a circular aperture, which is also of a diameter sufficient to permit ready passage of a single gumball, in the side wall of the outer cylindrical tubular member. The inner cylindrical tubular member also has a top wall with a circular aperture of a size sufficient to readily pass a single gumball. Although the nested cylindrical tubular members are concentric about their respective axes, the circular aperture in the top of each of the members is offset with respect to the axes of the cylindrical tubular members. Passage of a gumball is permitted through the reservoir and each of the circular apertures, when they are in register in one relative rotational position of the two nested cylindrical tubular members, into a dispensing chamber defined in the inner cylindrical tubular member. However, passage of a gumball from the reservoir into the dispensing chamber is blocked in at least a second relative rotational position of the nested cylindrical tubular members. Also contained in the cylindrical side wall of the inner cylindrical tubular member is a circular aperture of a size sufficient to permit the dispensing of a single gumball from the dispensing chamber when the side wall aperture of the inner cylindrical tubular member is in rotational register with the side wall circular opening of the outer cylindrical tubular member. The circular apertures in the top walls and in the side walls of the inner and outer cylindrical tubular members are approximately 180 degrees out of phase. Accordingly, when the circular apertures in the side walls of the inner and outer cylindrical tubular members are in register, the inner cylindrical tubular member is in a relative rotational position such that the circular aperture in the top of the inner cylindrical tubular member is in the second, gumball blocking position. Even in the second, gumball blocking position, the apertures in the respective tops of the inner and outer cylindrical members overlap each other although not sufficiently to permit the passage of a gumball. The diameters of the apertures are each more than one-half of the inside diameter of the inner cylindrical tubular member and the diameters of the apertures in the side walls are approximately equal to the height of the dispensing chamber.

A cooperating annular ridge around the outside surface of the inner cylindrical tubular member and an annular groove in the inside surface of the outer cylindrical tubular member retain the tubular members in the nested assembly while permitting their relative rotational movement. Preferably, the annular ridge and the annular groove are formed in the respective cylindrical tubular members below the aperture in the side walls and above the bottom of the tubular members. The base may be secured to the nested assembly for rotation with either the inner cylindrical tubular member or the outer cylindrical tubular member. Formed in an upwardly facing surface of a raised central portion of the base member that fits into the open bottom of the inner cylindrical tubular member is a depression or directional channel. The depression increases in width and depth as it extends from one side of the raised portion to an opposite side. The base is secured to the nested assembly of the inner and outer cylindrical tubular members such that the directional channel is oriented to facilitate a gumball rolling toward the apertures in the side walls of the inner and outer tubular members when such apertures are in register to permit the dispensing of a gumball from the dispensing chamber. An arcuate groove is formed in the underside of the top wall of the outer cylindrical tubular member and a bead projecting upwardly from the top wall of the inner cylindrical tubular member in received for movement in the arcuate groove. The bead stops at one end of the arcuate groove when the apertures in the top walls of the nested cylindrical tubular members are in register and bead stops at the other end of the arcuate groove when the apertures in the side walls of the nested cylindrical tubular members are in register.

BRIEF DESCRIPTION OF THE DRAWINGS

For better understanding of the present invention, reference may be had to the accompanying drawings in which.

DETAILED DESCRIPTION

Figure 1:
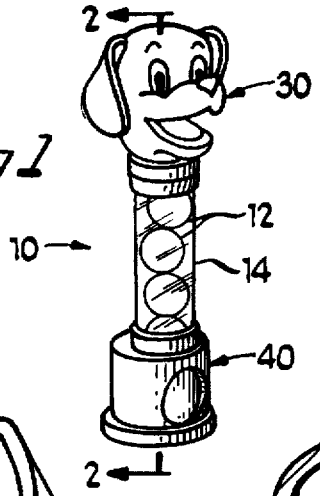
FIG. 1 is a perspective view of an embodiment of the present invention.

Referring now to the drawings in which parts are designated by like reference numerals throughout the several views, there is shown in FIG. 1 a portable gumball dispenser 10 containing a number of gumballs 12 in an elongated tubular reservoir 14. Gumball dispenser 10 may conveniently made of a size readily carried upon the person of the user with the dispenser being approximately 4.5 inches high and just over 1.5 inches wide. A dispenser of the size described, would accommodate five gumballs 12, each having an approximate average diameter of 0.555 inches. However, a dispenser according to the present invention is not so limited in size and may readily be made with a greater reservoir capacity. In the embodiment illustrated, the tubular reservoir 14 has an inner diameter of approximately 0.655 inches so as to readily accommodate gumballs, or other spherical confectioneries such as jawbreakers, having an approximate average diameter of 0.555 inches. A height of approximately 2.2 inches for tubular reservoir 14 allows dispenser 10 to accommodate, four gumballs within the reservoir itself. Reservoir 14 is preferably made of a transparent plastic so that the gumballs contained in the reservoir may be easily viewed.

Tubular reservoir 14 has a generally circular bottom opening 16 and a generally circular top opening 18. Secured on top of tubular reservoir 14 is a cap or head mounting flange member 20 with a tubular collar 22. The inside diameter of collar 22 is such that there is an interference fit with tubular reservoir 14. Head mounting flange 20 has a generally circular opening 24 which, when flange 20 is secured atop reservoir 14, is in register with top opening 18 of the reservoir. Extending laterally from collar 22 is a mounting tab 26 with an aperture 28. Mounted atop dispenser 10 or more particularly atop cap or head flange mounting member 20, for rotational movement relative to it, is a cap or head 30 having a depending neck portion 32. Head 30 may conveniently be formed to represent the head of a readily recognizable character, such as a licensed character, or a design of any other choosing. Neck 32 is generally circular with an outer diameter sized fit into opening 24 of head mounting flange 20. At its bottom, more particularly along its bottom outside edge, neck 32 is provided with a rounded cam surface 34.

Figure 2:
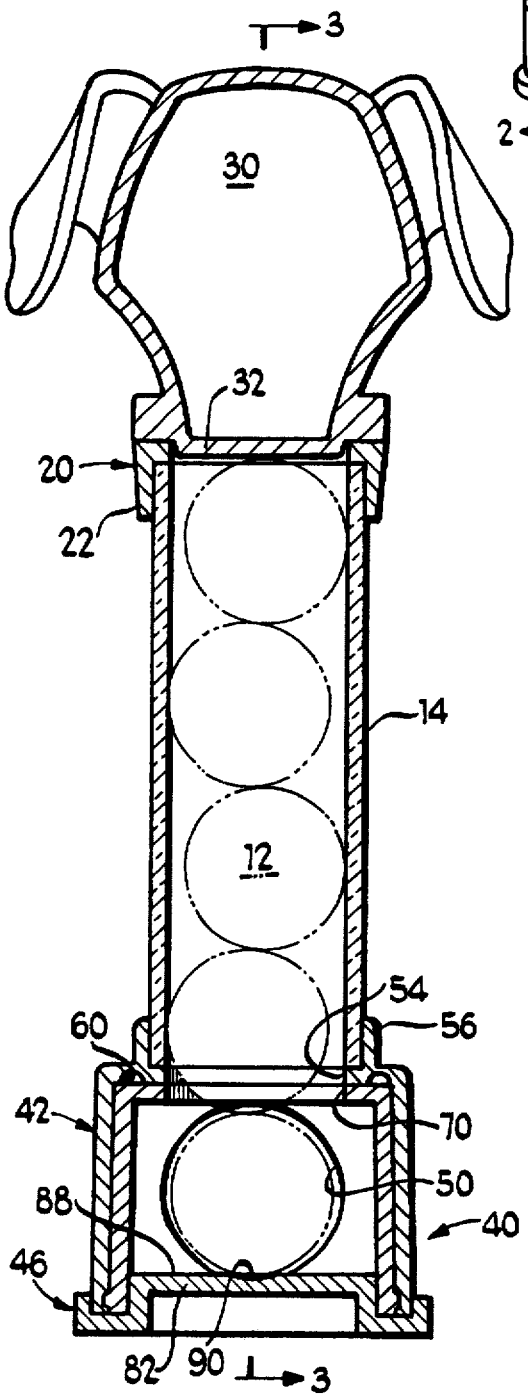
FIG. 2 is a enlarged scale, sectional view taken generally along line 2—2 of FIG. 1.
Figure 3:
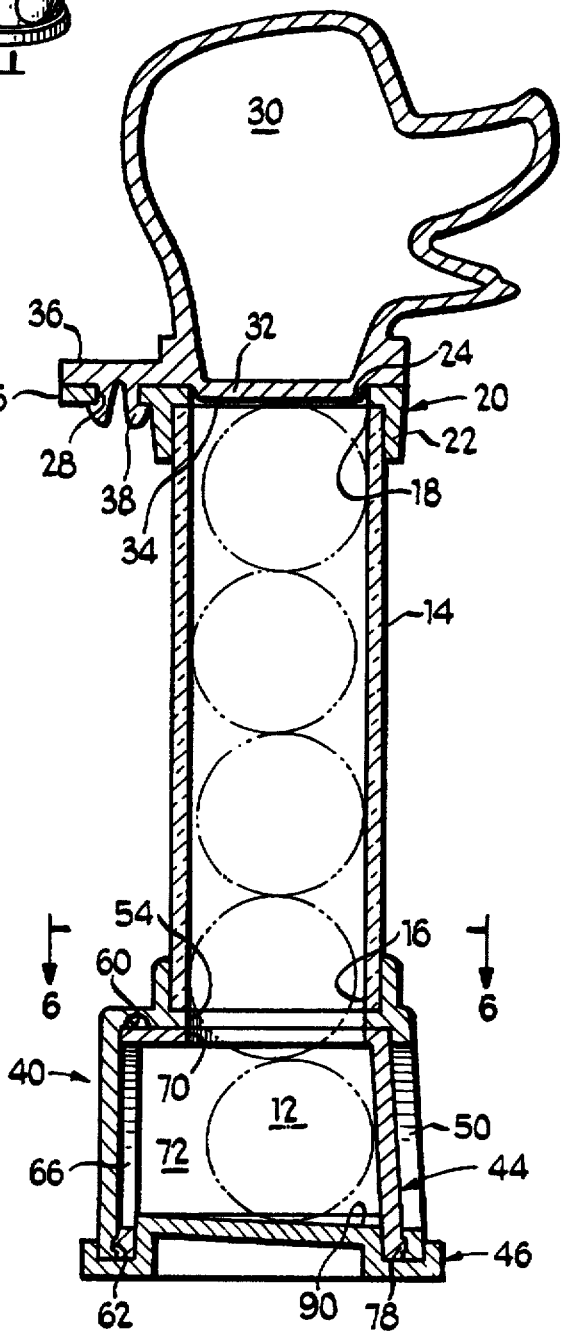
FIG. 3 is a sectional view taken generally along line 3—3 of FIG. 2.
Figure 9:
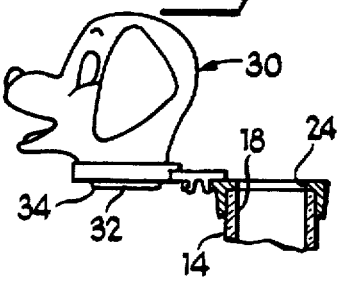
FIG. 9 is a fragmentary side elevation, partly in section, showing the top cap rotated out of the reservoir top closed position into the reservoir top open position.

Extending rearwardly from adjacent the lower end of neck 32 is a mounting arm 36 having an integrally formed downwardly depending, bifurcated barb member 38. To assemble head 30 to mounting flange 20, the free ends of bifurcated barb member 38 are compressed together and inserted in aperture 28 of tab 26. As is perhaps best illustrated in FIG. 3, neck 32 depends below mounting arm 36 a sufficient distance to securely seat head 30 within opening 24 of flange 20 to prevent inadvertent rotational dislocation of head 30. In the position illustrated in FIGS. 1, 2 and 3, head 30 caps or covers tubular reservoir 14 and seals gumballs 12 within the reservoir. To permit access to reservoir 14 for the purpose of refilling it, head 30 is rotated or pivoted approximately 180 degrees to the position illustrated in FIG. 9 to provide ready access for the introduction of additional gumballs into reservoir 14. As head 30 is pivoted from its position in register with openings 24 and 18, rounded cam surface 34 bears against the upper edge of opening 24 to cam or deflect the depending portion of neck 32 out of opening 24.

Gumball dispenser 10 has a pedestal 40 comprised of two generally cylindrical tubular members 42 and 44 plus a generally round disc base 46. Generally cylindrical tubular members 42 and 44 are concentrically nested for relative rotational movement. Pedestal 40 must be of a size compatible with the overall size of the portable gumball dispenser. This size limitation and the size of the gumballs to be dispensed are critical parameters that the dispensing mechanism must accommodate.

Tubular member 42 has a side wall 48 in which is formed a generally circular aperture 50 of a size, generally 0.687 inches, that readily permits passage of a single gumball 12. The bottom of tubular member 42 is open. Tubular member 42 has a top wall 52. Extending through top wall 52, offset from the central access of tubular member 42, is a generally circular aperture 54 having a diameter sufficient to readily permit passage of a single gumball 12. Aperture 54 in top wall 52 of outer tubular member 42 is offset toward aperture 50 in side wall 48. The outside diameter of outer tubular member is approximately 1.115 inches.

Figure 4:
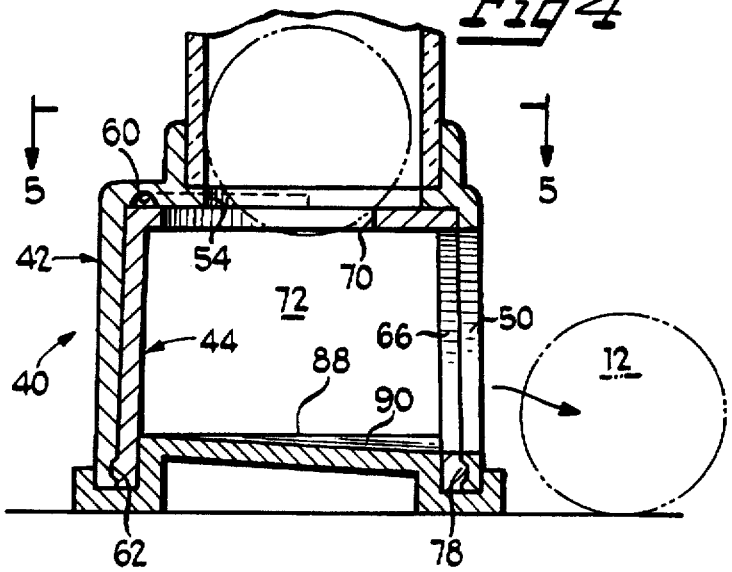
FIG. 4 is a fragmentary sectional view showing the inner nested generally cylindrical tubular member rotated approximately 180 degrees.
Figure 8:
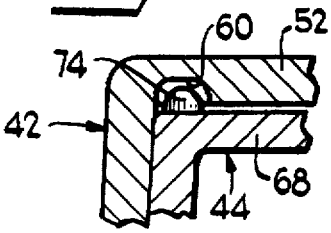
FIG. 8 is an enlarged scale, fragmentary sectional view of an upper corner of the nested inner and outer cylindrical tubular members.

Extending upwardly from top wall 52 and disposed around aperture 54 is a collar 56 having a generally cylindrical opening 58. As with opening 24 of flange 20, the inside diameter of opening 58 is such that there is an interference fit with tubular reservoir 14. As is readily appreciated from FIGS. 2, 3 and 4, when reservoir 14 is seated in collar 56, bottom opening 16 of reservoir 14 is in register with opening 54 in top 52 of outer generally cylindrical tubular member 42. Formed in the underside of top 52 is an arcuate groove 60 whose center is the central axis of outer tubular member 42. Arcuate groove 60 extends through approximately 180 degrees. Along the lower inside edge of outer tubular member 42, below the bottom opening of 50 and above the bottom edge of outer tubular member 44 is an annular groove 62.

Generally cylindrical inner tubular member 44 has a side wall 64. The outside diameter of inner tubular member 44 is slightly less than the inner diameter of outer tubular member 42 such that inner tubular member 44 closely nests within outer tubular member 42 without any interference to allow relative rotational movement. A generally circular aperture 66 of a size, generally 0.687 inches, that is sufficient to readily permit the passage of a single gumball 12 is formed in side wall 64. The bottom of inner tubular member 44 is open. Across the top of inner tubular member 44 is a top wall 68. Extending through top wall 68 is a generally circular aperture 70 of a size, generally 0.650 inches, that is sufficient to readily permit the passage of a single gumball 12. Aperture 70 is offset from the central axis tubular member 44 away from aperture 66 in side wall 64. The inside diameter of inner tubular member is approximately 0.870 inches.

In one relative rotational position of inner tubular member 44 and outer tubular member 42, their respective apertures 70 and 54 are in register to permit the passage of a gumball down from reservoir 14 into the inside of inner tubular member 44 which, in part, defines a dispensing chamber 72 sized to receive and contain a single gumball. However, when apertures 54 and 70 are in register to permit the passage of a gumball down from reservoir 14 into dispensing chamber 72, apertures 50 and 66 in the side walls are approximately 180 degrees out of phase to effectively seal the side walls of dispensing chamber 72.

Figure 5:
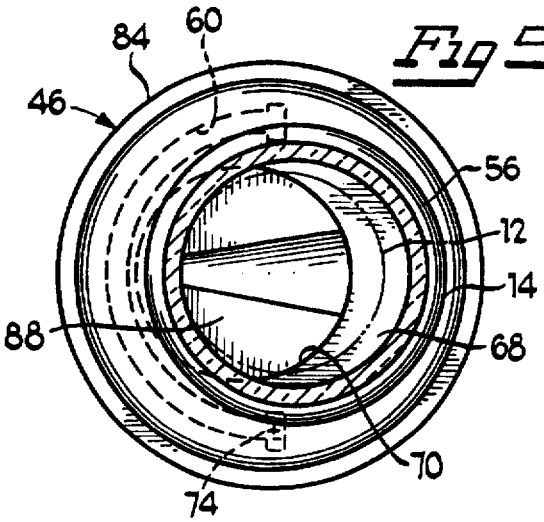
FIG. 5 is a sectional view taken generally along line 5—5 of FIG. 4.
Figure 7:
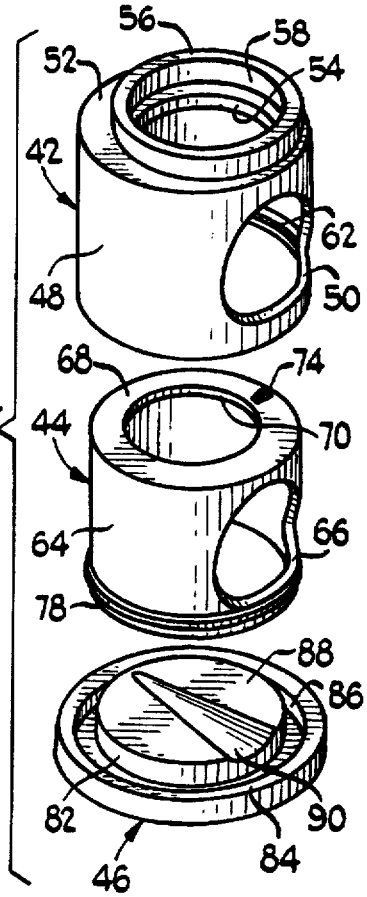
FIG. 7 is an exploded perspective view of the inner and outer generally cylindrical tubular members together with the base.
Figure 6:
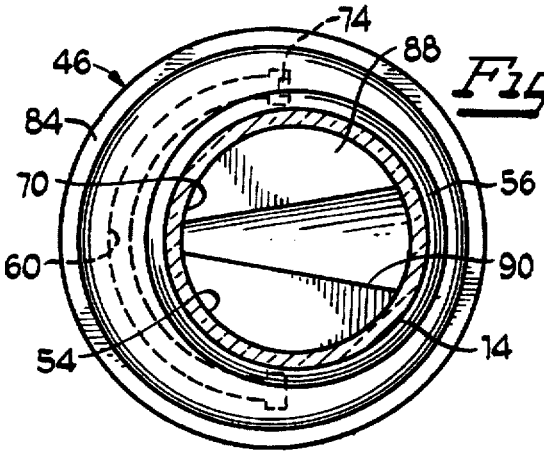
FIG. 6 is a sectional view taken generally along line 6—6 of FIG. 3.

Projecting upwardly from top wall 68 of inner tubular member 44 is a bead 74 which is received in groove 60 on the underside of top wall 52 of outer tubular member 42. Thus, bead 74 cooperates with arcuate groove 60 to form stops at each end of arcuate groove 60. As is best shown in FIGS. 5 and 6, with bead 74 at one end of arcuate slot 60, apertures 54 and 70 are in register permitting the passage of a gumball 12 into dispensing chamber 72. With bead 74 at the opposite end of arcuate slot 60, apertures 54 and 70 are out of register such that a significant portion, approximately thirty percent, of aperture 54 is blocked by top wall 68 of inner tubular member 44 to prevent the passage of a single gumball 12 from reservoir 14 into dispensing chamber 72.

Extending circumferencially outwardly from the outer surface of side wall 64 of inner tubular member 44 is an annular beveled ridge 78. Similar to annular groove 62 on the inside of side wall 48 of outer tubular member 44, annular beveled ridge 78 is disposed below the bottom of opening 66 in side wall 64 and above the bottom of side wall 64. Upon inserting inner tubular member 44 into outer tubular member 42 through the open bottom of outer tubular member 44, annular beveled ridge 78 is force fit into annular groove 62 to form a nested assembly. With ridge 78 seated in groove 62, inner tubular member 44 is retained in its nested position within outer tubular member 42 while permitting relative rotational movement of the nested tubular members.

Base 46 is provided to seal the opened bottoms of outer and inner tubular members, 42 and 44 respectively, and further define dispensing chamber 72. Base 46 is a generally circular disc with a raised central portion 82 and an outer rim 84. An annular groove 86 is defined between raised central portion 82 and rim 84. In the upper surface 88 of raised central portion 82, a depression 90 is formed. Depression 90 extends generally from one side of raised central portion 82 toward an opposite side with both an increasing depth and width. Thus, depression 90 creates a directional channel for a spherical object such as a gumball 12 to roll.

In order to secure base 46 to the nested assembly of outer and inner tubular members 42 and 44, respectively, the outer diameter of central raised portion 82 may be such as to form an interference fit with the inside diameter of inner tubular member 44 so that base 46 rotates with inner tubular member 44. Alternatively, the inside diameter of rim 84 may be such as to cause an interference fit with the outside diameter of side wall 48 of outer tubular member 42 in which case base 46 would rotate with outer tubular member 42. In either alternative, depression or directional channel 90 should be so oriented that when apertures 50 and 66 are in register to permit dispensing of a gumball 12 from dispensing chamber 72, the larger end of directional channel 90 is aligned with openings 50 and 66 facilitating a gumball 12 rolling out of dispensing chamber 72. A snap fit between the base and the nested assembly similar to that used for resealable food storage containers may be used. As further alternatives, adhesives or ultrasonic welding may be used to secure the base to the nested assembly.

While a particular embodiment of the present invention has been shown and described with some alternatives, it will be apparent that further changes and alternatives will occur to those skilled in the art. It is intended in the appended claim to cover all such changes and modifications as fall within the true spirit and scope of the present invention.

What is claimed as new and desired to be secured by Letters Patent is:

1. A portable gumball dispenser comprising in combination:

a reservoir for storing a number of gumballs, the reservoir having a top and bottom; and an opening in the bottom of the reservoir permitting the passage of a single gumball;

an opening in the top of the reservoir permitting the filling of the reservoir with one or more gumballs;

a cap for selectively closing the opening in the top of the reservoir;

a pedestal on top of which the reservoir is mounted and which forms a dispensing chamber for dispensing one gumball at a time;

the pedestal including a base and a nested assembly of relatively rotatable tubular members;

the nested assembly including an outer tubular member and an inner tubular member;

the outer and inner tubular members each having a bottom that is generally open;

the base being secured to the nested assembly to close the generally open bottoms of the outer and inner tubular members;

each of the outer and inner tubular members having a respective top wall and a respective cylindrical side wall;

each of the outer and inner tubular members having an axis;

the axes of the outer and inner tubular members being generally concentric in the nested assembly;

an aperture permitting the passage of a single gumball in the side wall of the outer tubular member;

an aperture permitting the passage of a single gumball in the top wall of the outer tubular member;

the aperture in the top wall of the outer tubular member being offset from the axis of the outer tubular member toward the aperture in the side wall of the outer tubular member;

an aperture permitting the passage of a single gumball in the side wall of the inner tubular member;

an aperture permitting the passage of a single gumball in the top wall of the inner tubular member; and the aperture in the top wall of the inner tubular member being offset from the axis of the inner tubular member away from the aperture in the side wall of the inner tubular member.

2. The portable gumball dispenser of claim 1 in which the apertures in the respective top walls of the inner and outer tubular members overlap to some degree in every relatively rotatable position of the nested assembly of the inner and outer tubular members.

3. The portable gumball dispenser of claim 1 in which the dispensing chamber holds only one gumball at a time.

4. The portable gumball dispenser of claim 1 in which the diameter of the circular apertures in the side walls of the outer and inner tubular members is approximately equal to the height of the dispensing chamber.

5. The portable gumball dispenser of claim 1 in which the diameter of the circular aperture in the top wall of the inner tubular member is more than one-half of the outside diameter of the outer tubular member.

6. The portable gumball dispenser of claim 1 in which the diameter of the circular aperture in the top wall of the inner tubular member is more than one-half of the inside diameter of the inner tubular member.

7. The portable gumball dispenser of claim 6 in which the diameter of the circular aperture in the top wall of the inner tubular member is approximately three-quarters of the inside diameter of the inner tubular member.

8. The portable gumball dispenser of claim 1 in which:

the cylindrical side wall of the outer tubular member has an inside surface;

an annular groove is formed in the inside surface of the side wall of the outer tubular member;

the inner tubular member cylindrical side wall has an outer surface;

an annular ridge is formed around the outer surface of the cylindrical side wall of the inner tubular member; and the annular ridge is seated in the annular groove in the nested assembly to retain the inner tubular member nested within the outer tubular member while permitting relative rotational movement between the inner tubular member and the outer tubular member.

9. The portable gumball dispenser of claim 8 in which the annular groove and annular ridge are each dispensed below the side wall aperture and above the bottom of the respective tubular member.

10. The portable gumball dispenser of claim 1 in which the base is secured to the nested assembly to rotate with the inner tubular member.

11. The portable gumball dispenser of claim 1 in which the base is secured to the nested assembly to rotate with the outer tubular member.

12. The portable gumball dispenser of claim 1 in which:

the base has a raised central circular portion;

the base also includes a raised circular rim spaced from the raised central portion by an annular groove; and the nested assembly of the inner and outer tubular member is received in the annular groove with the raised central portion extending upwardly into the open bottom of the inner tubular member.

13. The portable gumball dispenser of claim 12 in which:

the raised central portion of the base has an upwardly facing surface; and a directional channel is formed in the upwardly facing surface extending generally from one side of the raised central portion toward an opposite side.

14. The portable gumball dispenser of claim 13 in which the directional channel is formed by increasing the depth and width of the channel from the one side toward the opposite side.

15. The portable gumball dispenser of claim 13 in which the directional channel is oriented to direct a gumball toward the apertures of the side walls in the inner and outer tubular members when such apertures are in register to permit the dispensing of a gumball from the dispensing chamber.

16. The portable gumball dispenser of claim 12 in which the raised central portion is generally cylindrical and has a diameter sufficient to cause an interference fit with the open bottom of the inner tubular member.

17. The portable gumball dispenser of claim 12 in which the raised rim of the base has an inner diameter sufficient to cause an interference fit with the cylindrical side wall of the outer tubular member.

18. The portable gumball dispenser of claim 1 in which:

the top wall of the outer tubular member has an underside;

an arcuate groove is formed in the underside of the top wall of the outer tubular member;

a bead projects upwardly from the top wall of the inner tubular member; and the bead is received for movement in the arcuate groove on the underside of the top wall of the outer tubular member in the nested assembly.

19. The portable gumball dispenser of claim 15 in which:

the center for the arcuate groove coincides with the axes of the outer and inner tubular members; and the arcuate groove extends approximately 180 degrees.

20. The portable gumball dispenser of claim 18 in which:

the bead is at one end of the arcuate groove when the circular apertures in the top walls of the tubular members are in register; and the bead is at the outer end of the arcuate groove when the circular apertures in the side walls of the tubular members are in register.

* * * * *

UNITED STATES PATENT AND TRADEMARK OFFICE

CERTIFICATE OF CORRECTION

PATENT NO. : 5,779,095
DATED : July 14, 1998
INVENTOR(S) : Sidney Diamond

It is certified that error appears in the above-indentified patent and that said Letters Patent is hereby corrected as shown below:

| | |
|---|---|
| Col. 8, Ln 35 | Delete "claim 15" and instead Insert --claim 18-- |

Signed and Sealed this

Fifteenth Day of September, 1998

Bruce Lehman

*Attest:*

BRUCE LEHMAN

*Attesting Officer*

*Commissioner of Patents and Trademarks*